US008007330B2

(12) United States Patent
Wong et al.

(10) Patent No.: US 8,007,330 B2
(45) Date of Patent: Aug. 30, 2011

(54) STEERING APPARATUS WITH INTEGRATED STEERING ACTUATOR

(75) Inventors: Tat Lung Ray Wong, Richmond (CA); Jon Scott, Vancouver (CA)

(73) Assignee: Teleflex Canada Inc., Richmond (CA)

( * ) Notice: Subject to any disclaimer, the term of this patent is extended or adjusted under 35 U.S.C. 154(b) by 161 days.

(21) Appl. No.: 12/418,785

(22) Filed: Apr. 6, 2009

(65) Prior Publication Data

US 2009/0253317 A1 Oct. 8, 2009

Related U.S. Application Data

(60) Provisional application No. 61/043,277, filed on Apr. 8, 2008.

(51) Int. Cl.
*B63H 5/125* (2006.01)
*B63H 20/08* (2006.01)

(52) U.S. Cl. ..... 440/61 S

(58) Field of Classification Search ..... 440/49, 440/51, 53, 55–59, 61 R, 61 S; 114/144 R, 114/154–158, 144 RE
See application file for complete search history.

(56) References Cited

U.S. PATENT DOCUMENTS

| | | | |
|---|---|---|---|
| 6,843,195 | B2 | 1/2005 | Watabe et al. |
| 6,868,317 | B2 | 3/2005 | Okuyama |
| 7,128,627 | B2 | 10/2006 | Ferguson |
| 7,134,924 | B2 | 11/2006 | Takada et al. |
| 7,137,347 | B2 | 11/2006 | Wong et al. |
| 7,220,157 | B2 | 5/2007 | Pettersson |
| 7,226,326 | B2 | 6/2007 | Mizuguchi et al. |
| 7,258,072 | B2 | 8/2007 | Wong et al. |
| 2005/0095931 | A1 | 5/2005 | Takada et al. |
| 2005/0241556 | A1 | 11/2005 | Takada et al. |
| 2005/0263058 | A1 | 12/2005 | Suemori et al. |

FOREIGN PATENT DOCUMENTS

| | | |
|---|---|---|
| CA | 2430548 | 11/2003 |

*Primary Examiner* — Daniel V Venne
(74) *Attorney, Agent, or Firm* — Cameron IP

(57) ABSTRACT

The present invention relates to a steering apparatus for a marine craft. The marine craft has a stern and a propulsion unit. The steering apparatus includes a stern bracket connectable to the stern of the marine craft. A swivel case is connected to the stern bracket. The swivel case defines a steering axis. The steering apparatus includes an electric motor coaxially disposed within the swivel case for swivelling the propulsion unit about the steering axis. The steering apparatus includes a gear reducing unit having an input operatively engageable with the electric motor and an output. A first member operatively extends from the output and is connectable to the propulsion unit.

32 Claims, 7 Drawing Sheets

STEERING APPARATUS WITH INTEGRATED STEERING ACTUATOR

CROSS REFERENCE TO RELATED APPLICATION

This application claims the benefit of provisional application 61/043,277 filed in the United States Patent and Trademark Office on Apr. 8, 2008, the disclosure of which is incorporated herein by reference and priority to which is claimed pursuant to 35 U.S.C. section 120.

FIELD OF THE INVENTION

The present invention relates to a steering apparatus. More particularly, it relates to a steering apparatus having an integrated steering actuator.

DESCRIPTION OF THE RELATED ART

It is known to use a steering motor for steering an outboard motor through a swivel shaft. For example, United States Patent Application Publication No. 2005/0095931 A1 to Takada et al. shows a steering motor connected through a gear box to a swivel shaft for swivelling an outboard motor However, Takada suffers from a number of disadvantages. Takada teaches the use of a gear box that requires many parts, including many gears and shafts. The gears are large in order to achieve the proper gear reduction ratios and this necessitates an excess use of space. Takada requires these gears and shafts to be manufactured within tight tolerances. Also, the gears and shafts need to be properly aligned and installed to within tight tolerances.

Moreover, while the gearbox and steering motor are within the outboard motor, the steering motor and gears may be prone to accelerated failure due to exposure to dust, grit, and water including trapped moisture, and the like.

All of these above factors may lead to higher costs and higher rates of failure for such steering systems.

There is therefore a need for an improved steering apparatus for marine crafts.

BRIEF SUMMARY OF INVENTION

The present invention provides a steering apparatus that overcomes the above disadvantages. It is an object of the present invention to provide an improved steering apparatus.

According to one aspect of the invention, there is provided a steering apparatus for a marine craft. The marine craft has a stern and a propulsion unit. The apparatus includes a stern bracket connectable to the stern of the marine craft. A swivel case is connected to the stern bracket. The swivel case defines a steering axis. The apparatus includes an electric motor coaxially disposed within the swivel case for swivelling the propulsion unit about the steering axis. The apparatus includes a gear reducing unit having an input operatively engageable with the electric motor and an output. A first member operatively extends from the output and is connectable to the propulsion unit.

According to another aspect of the invention, there is provided a steering apparatus for a marine craft having a stern and a propulsion unit. The apparatus includes a stern bracket connectable to the stern of the marine craft. The apparatus includes a swivel case pivotally connected to the stern bracket. The swivel case has a top end and a bottom end spaced apart from the top end. The swivel case defines a steering axis. The apparatus includes an electric motor substantially coaxially disposed within the swivel case for swivelling the propulsion unit about the steering axis. The electric motor has a lower shaft extending towards the bottom end, and an upper shaft opposite the lower shaft extending towards the top end. The apparatus includes a plurality of lower planetary gears having an input operatively engageable with the lower shaft of the electric motor and an output. The apparatus includes a plurality of upper planetary gears having an input operatively engageable with the upper shaft of the electric motor and an output. A first member operatively extends from the output of the lower planetary gears and is connectable to the propulsion unit. A second member operatively extends from the output of the upper planetary gears and is connectable to the propulsion unit.

According a further aspect of the invention, there is provided, in combination, a propulsion unit and a steering apparatus for mounting on a stern of a marine craft. The apparatus includes a stern bracket connectable to the stern of the marine craft. A swivel case is pivotally connected to the stern bracket. The swivel case defines a steering axis. The apparatus includes an electric motor coaxially disposed within the swivel case for swivelling the propulsion unit about the steering axis. The apparatus includes a gear reducing unit having an input operatively engageable with the electric motor and an output. A first member operatively extends from the output and is connectable to the propulsion unit.

BRIEF DESCRIPTION OF DRAWINGS

Referring to the drawings.

DESCRIPTION OF THE PREFERRED EMBODIMENTS

Figure 1:
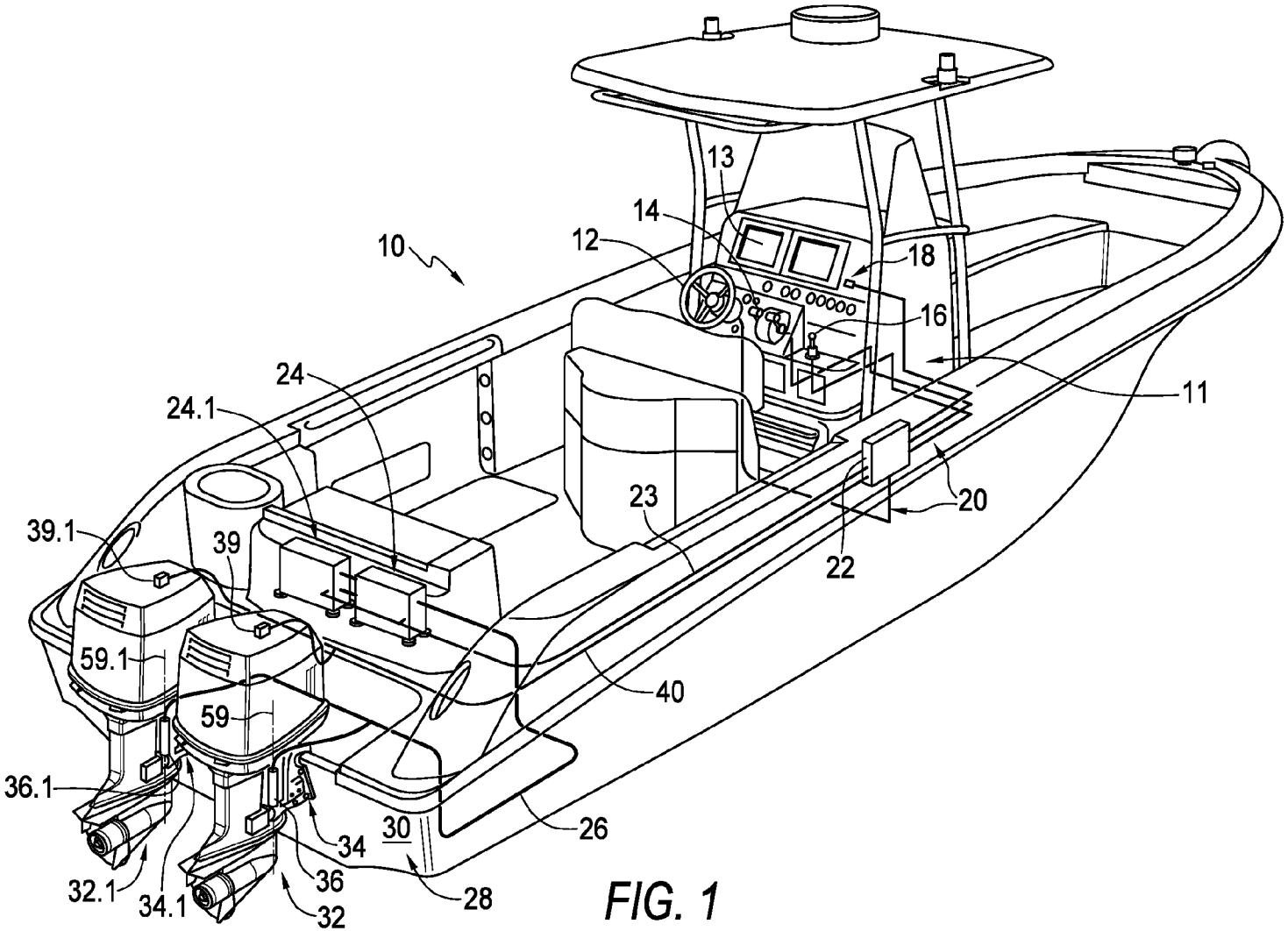
FIG. 1 is a perspective view, partly in ghost, of a marine craft having a steering apparatus and propulsion unit mounted thereon.

Referring to the drawings and first to FIG. 1, this shows a boat 10 having an electric steering system 11. The system 11 includes a user interface 18 that provides for warnings and a means for adjusting of the system. A buzzer and a warning lamp are employed in the system in this example and a textual or graphic interface 13 can also be used. The system 11 includes a steering helm 12, shift and throttle controller 14, a vessel controller, joystick 16 in this example, in addition to the user interface 18. All in these examples are connected to a vessel controller 22 by wires 20. The wires are part of a communication bus in this example. In another embodiment, the connections could be hardwired instead of using a communication bus. Also, while the term "wire" is used herein, other conductors, such as fibre optic cables or wireless communication, could be used. The communication bus can be for example a CAN bus, LIN bus, or wireless communication. The vessel controller is in communication via wires 23 to the steering controller 24, which in this example is mounted near the stern 28 of the boat 10.

Shift and throttle controllers 39 and 39.1 are also connected to the vessel controller 22 via wire 40. Wire 23 and wire 40 are parts of two independent communication buses that provide redundancy. In another embodiment, wire 23 can connect to all steering controllers 24 and 24.1, shift and throttle controllers 39 and 39.1, and the vessel controller. Similarly, wire 40 can connect to all devices. A dual reduant communication architecture can be used.

FIG. 1 shows a propulsion unit, in this example, twin outboard motors 32 and 32.1 mounted via steering apparatuses 34 and 34.1, respectively, to a transom 30 at the stern 28 of the boat 10. The twin outboard motors 32 and 32.1 rotate about steering axes 59 and 59.1, respectively. A tie bar is not required in the present invention for connecting the twin outboard motors 32 and 32.1 together. The steering apparatuses are substantially the same in structure and function as are the outboard motors. Accordingly, only one of the steering apparatus 34 and one of the outboard motors 32 will be focused on in detail.

Figure 2:
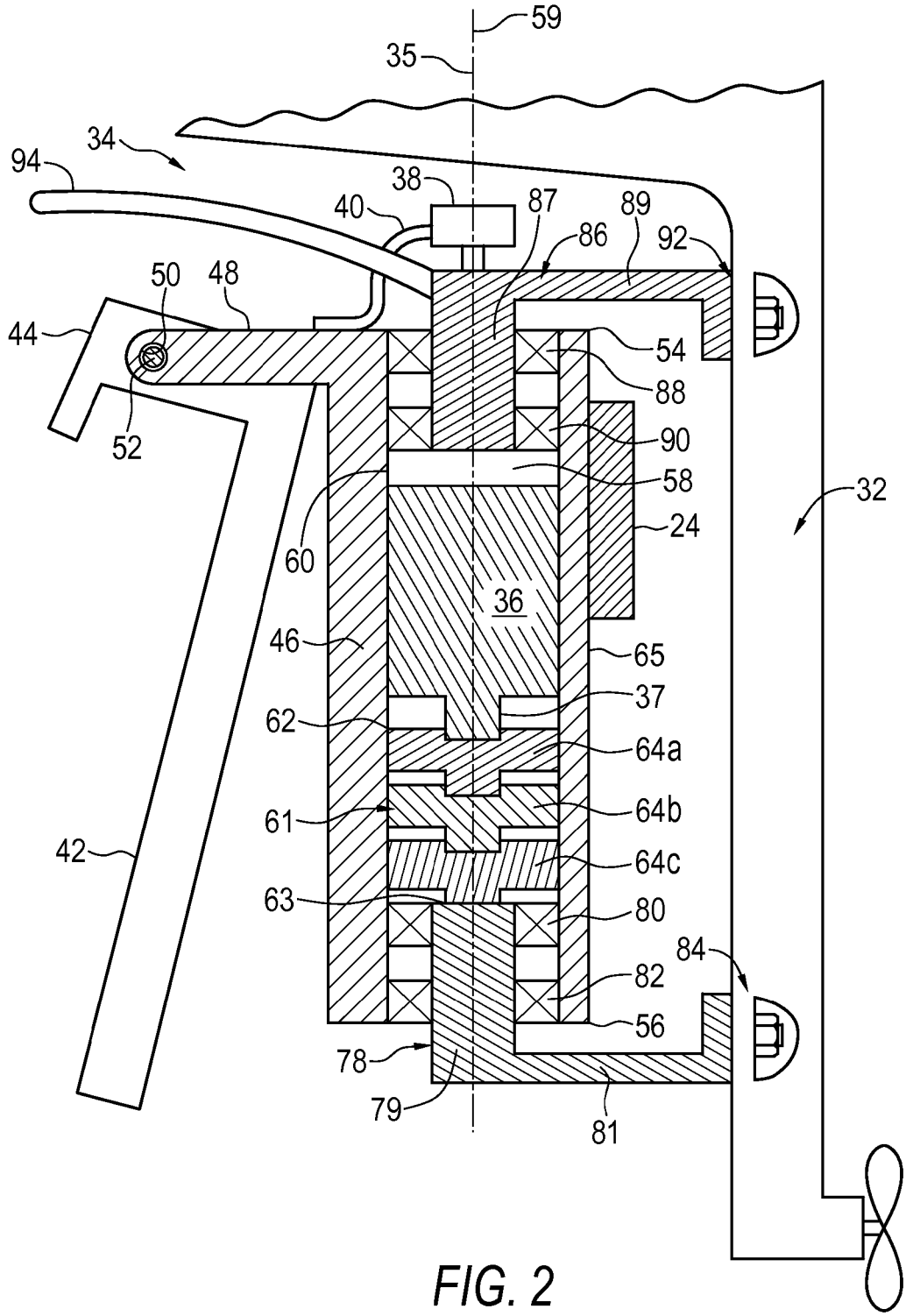
FIG. 2 is a simplified, partly diagrammatised, elevation view, partially in section, of a steering apparatus according to an embodiment of the invention.

The steering apparatus 34 includes a steering actuator which in this example is in the form of an electric motor 36 which is best shown in FIG. 2. Referring back to FIG. 1, the steering controller 24 is in communication through wires 26 with the electric motor 36. In one example, for a typical application of twin 300-hp outboard motors 32 and 32.1, the output requirement of the electric motors 36 and 36.1 can reach 650 ft-lbf at 30 degrees of rotation per second about the steering axes 59 and 59.1, and in this case a three-inch diameter dc brush motor of 300 oz-in torque at 2000 rpm is used.

Referring back to FIG. 2, the steering apparatus 34 is shown in greater detail. The steering apparatus includes a stern bracket 42 for mounting the steering apparatus 32 to the stern 30 of the boat 10. The stern bracket 42 has an upper end 44.

The steering apparatus includes a swivel case 46 having a top end 54 with an upper extension 48 radially extending outwards therefrom and a bottom end 56 spaced-apart from the top end 54. The swivel case 46 pivotally connects via the upper extension 48 to the upper end 44 of the stern bracket 42 at pivotal connection 50 so as to permit tilting of the outboard motor 32 about tilt axis 52. The swivel case 46 includes an outer wall 65 and in this example the steering controller 24 is mounted thereon, instead of being near the stern of the boat as shown in FIG. 1. The swivel case 46 has an elongate passageway, in this example, a cylindrical bore 58 extending from the top end 54 to the bottom end 56, and which provides the case 46 with an annular, inner wall 60. The case 46 defines a swivel axis or steering axis 59 which is substantially co-axial with the bore 58. In one example the swivel case 46 has an outside diameter of 4 inches.

The electric motor 36 is disposed within the swivel case 46 and in this example abuts the inner wall 60. The electric motor 36 has a motor axis 35, which in this example is substantially co-axial with the steering axis 59. The electric motor 36 has a drive shaft 37. A gear reducing unit which in this example is in the form of a plurality of planetary gears 61 is disposed within the swivel case 46, though in alternative embodiments other configurations of gears could be mounted exterior to the case. The plurality of planetary gears 61 engage via an input end of the gears, herein after referred to as input 62, with the drive shaft 37 of the electric motor. Input 62 can take the form of any means of connecting shafts to gears, as is known in the art. Standard planetary gears can be used in this regard and, in one example, the gears can be made of powder metal, providing the advantages being economic and modular. The plurality of planetary gears 61 in this example are coaxial with the steering axis 59 and comprise a number of stages 64*a*, 64*b*, and 64*c*, which, in this example, are mounted in series. Each stage is substantially the same in this example with one of the stages 64*a* being the same as the other stages 64*b* and 64*c*, with the exception that the gears of stage 64*a* near the motor have a smaller teeth width than the gears of the output stage 64*c*. Only one of the stages 64*a* is described in detail herein with the understanding that the other stages 64*b*, 64*c* have a similar structure and function. For the stages 64*b* and 64*c* like parts have been given like reference numerals as stage 64*a* with the additional alphabetic designation "b" and "c", respectively.

Figure 3A:
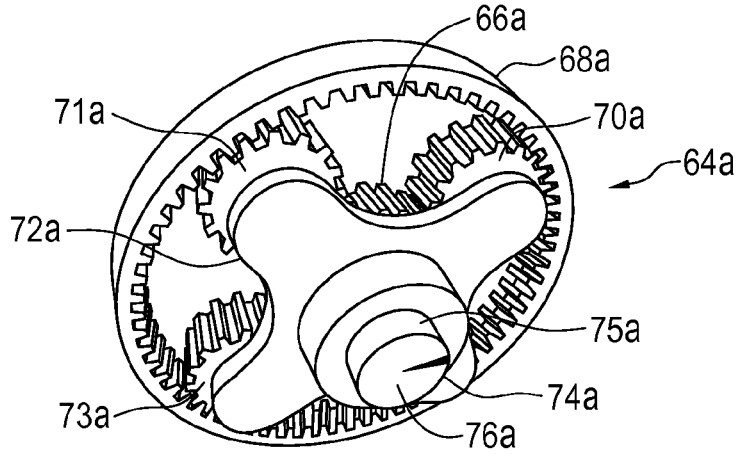
FIGS. 3A to 3C are exploded, perspective views of a plurality of planetary gears disposed within the steering apparatus of FIG. 2.
Figure 3B:
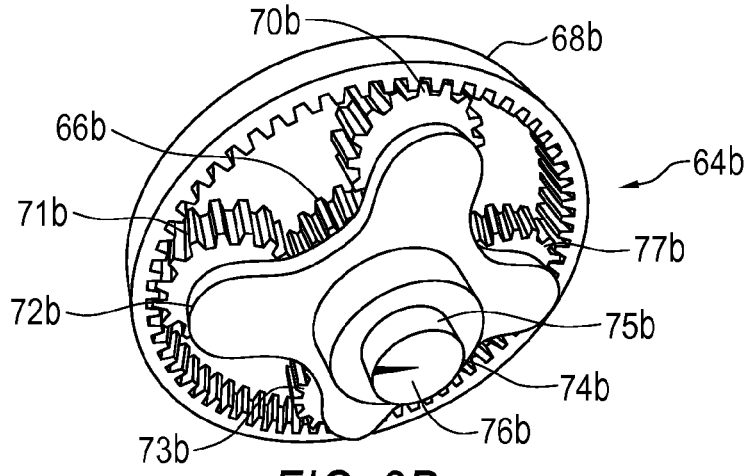

Referring to FIGS. 2 and 3, a first stage 64*a* of the planetary gears has a sun gear 66*a* co-axial with the steering axis 59, a ring gear 68*a*, four planet gears of which 70*a*, 71*a*, and 73*a* are shown (the fourth is shown in FIG. 3*b* as 77*b*). These are intermeshed between the sun gear 66*a* and the ring gear 68*a*. A planet carrier 72*a* supports the planet gears and has a shaft 75*a* having a distal end 76*a*. The ring gear 68*a* in this example is stationary and abuts the inner wall 60 of the swivel case 46. The input 62 of the plurality of gears 61 connects to the sun gear 66*a* of stage 64*a*. The distal end 76*a* of the shaft 75*a* connectably engages with the sun gear 66*b* of adjacent stage 64*b*. The plurality of planetary gears 61 have an output end, hereinafter referred to as output 63, that extends from the distal end 76*c* of the shaft 75*c* of the last stage 64*c*.

The gears have an involute gear profile of module 2 mm accordingly to one embodiment. However, modules of 1.5 to 3.0 mm are used in other examples although this is not critical. In the metric gear standard, module is defined as the pitch diameter divided by the number of teeth. It defines the tooth size. The bigger the module, the stronger is the gear. On the other hand, increasing the tooth thickness near the output stage increases the strength of the gear. Therefore, this example uses a smaller gear module (tooth size) on all gears apart from the output stage and uses a thicker tooth near the output stage. The sun gear has a pitch diameter of 75 mm, according to one embodiment of the invention, though diameters of between 60 mm to 90 mm are used on other examples depending on the torque requirement.

The operation of planetary gears in obtaining high gear reduction ratios is known and therefore will not be described in great detail. If the sun gear has S number of teeth, the ring gear has R number of teeth, and if the ring gear is held stationary, the gear ratios can be calculated by the following equation: 1+R/S=Gear Ratio.

Figure 3C:
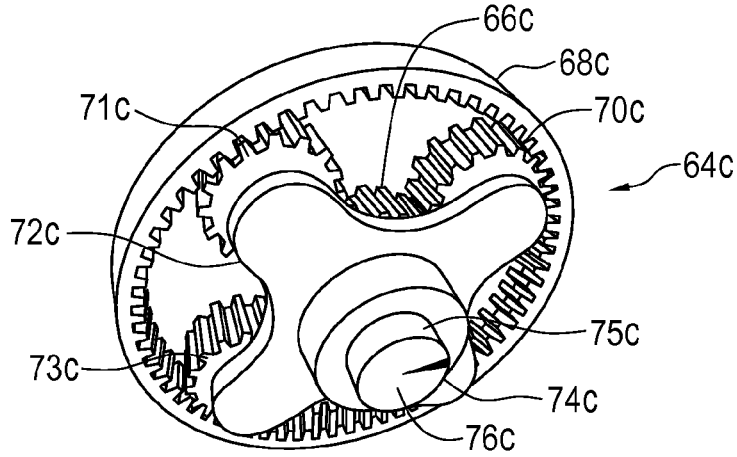

The number of teeth shown in FIGS. 3*a* to 3*c* as well as the number of stages 64*a*, 64*b*, and 64*c* are only by way of example and are in no way intended to limit or restrict the scope of the present invention. According to one embodiment of the invention, there are three stages of planetary gears each having a gear reduction ratio of 7:1 and resulting in a total gear reduction of 343:1. According to another embodiment of the invention, there are four stages of planetary gears each having a gear reduction ratio of 5:1 and resulting in a total gear reduction of 625:1.

Referring back to FIG. 2, the plurality of planetary gears 61 connect at the output 63 with a first member in the form of a lower mount 78. The lower mount 78 has a portion 79 coaxial with the steering axis 59 and is rotatably mounted within the swivel case by bearings 80 and 82. The lower mount 78 has a portion 81 extending away from the bottom end 56 of the swivel case and then extending radially outwards to connect to the outboard motor 32 at connection 84.

A second member, in this example an upper mount 86, extends from the top end 58 of the swivel case 46. The upper mount 86 has a portion 87 coaxial with the steering axis 59 and in this example is freely rotatably mounted within the swivel case through bearings 88 and 90. The upper mount 86 has a portion 89 extending away from the top end 58 and then extending radially outwards for connection with the outboard motor 32 at connection 92.

A rotation sensor 38 is shown connected to the upper mount 86 for illustrative purposes. The rotation sensor 38 provides a feedback position signal to the steering controller 24 of FIG. 1. The sensor 38 can be an absolute or an incremental sensor. In this example, a Honeywell® HMC1512 type magnetoresistive sensor is used. This provides a sine and cosine signal in 0.1 deg accuracy. The sensor 38 in this example is coaxial with the steering axis 59. A tiller arm 94 extends from the upper mount 86 but is not required.

In operation, and referring to FIGS. 1 and 2, when the user wants to steer the outboard motor 32, either the steering helm 12 or joystick 16 is manipulated. The steering helm or joystick thereby provides a steering command through the communication bus 22 via wire 23 to the steering controllers 24 and 24.1. The steering controllers 24 and 24.1 provide power through wires 26 to actuate the electric motors 36 and 36.1. With particular reference to FIG. 2, the shaft 37 of electric motor 36 thereby rotates to rotatably actuate the input 62 of the plurality of planetary gears 61. The planetary gears 61 thereby receive torque from the electric motor 36 and are configured to provide a high torque, low speed mechanical advantage at the output 63 for steering the boat. The lower mount 78 connects the output 63 with the outboard motor 32 and as a result causes the outboard motor to rotate or swivel about the steering axis 59 for steering the boat. The upper mount 86 rotates with the outboard motor in parallel with the lower mount and provides additional mounting support for the outboard motor. The rotation sensor 38 provides a feedback position signal, effectively corresponding to the position of the outboard motor, to the steering controller 24 via the communication bus 20 which includes wires 40 and 23.

The joystick 16 primarily allows the user to provide input to the vessel controller 22 for maneuvering the boat while docking. In one example, the vessel controller 22 can simultaneously control six actuations: the electric motors 36 and 36.1, the outboard motors 32 and 32.1, and the two shifting actuators.

One of the significant advantages of installing the electric motor 36 within the swivel case 46 is that it provides for heat dissipation. The casting of the swivel case provides a large thermal mass to absorb the heat generated by the motor 36 or the power electronics such as the steering controller 24 and rotation sensor 38. In operation, the swivel case is immersed in water and the water provides effective convection cooling.

A further advantage provided by the structure of the present steering apparatus is that it eliminates the need of a tiller arm 94. This results in fewer parts by doing away with the need for a hydraulic steering cylinder.

A further advantage of the embodiment of FIG. 2 is that it inhibits oil and other debris from contaminating or interfering with the motor 36. This is because oil from the plurality of gears 61 will simply gravitate downwards and hence away from the motor 36.

Also, the steering apparatus 34 when used with a steer-by-wire system allows for independent steering of the electric motors 36 and 36.1.

With the high gear ratio provided by the plurality of planetary gears 61, the electric motor 36 is not backdrivable. Accordingly, a further advantage of the present invention is that it acts to lock the outboard motor 32 when the motor is stopped without requiring a traditional lock valve or sprag clutch found in traditional steering mechanism.

Figure 4:
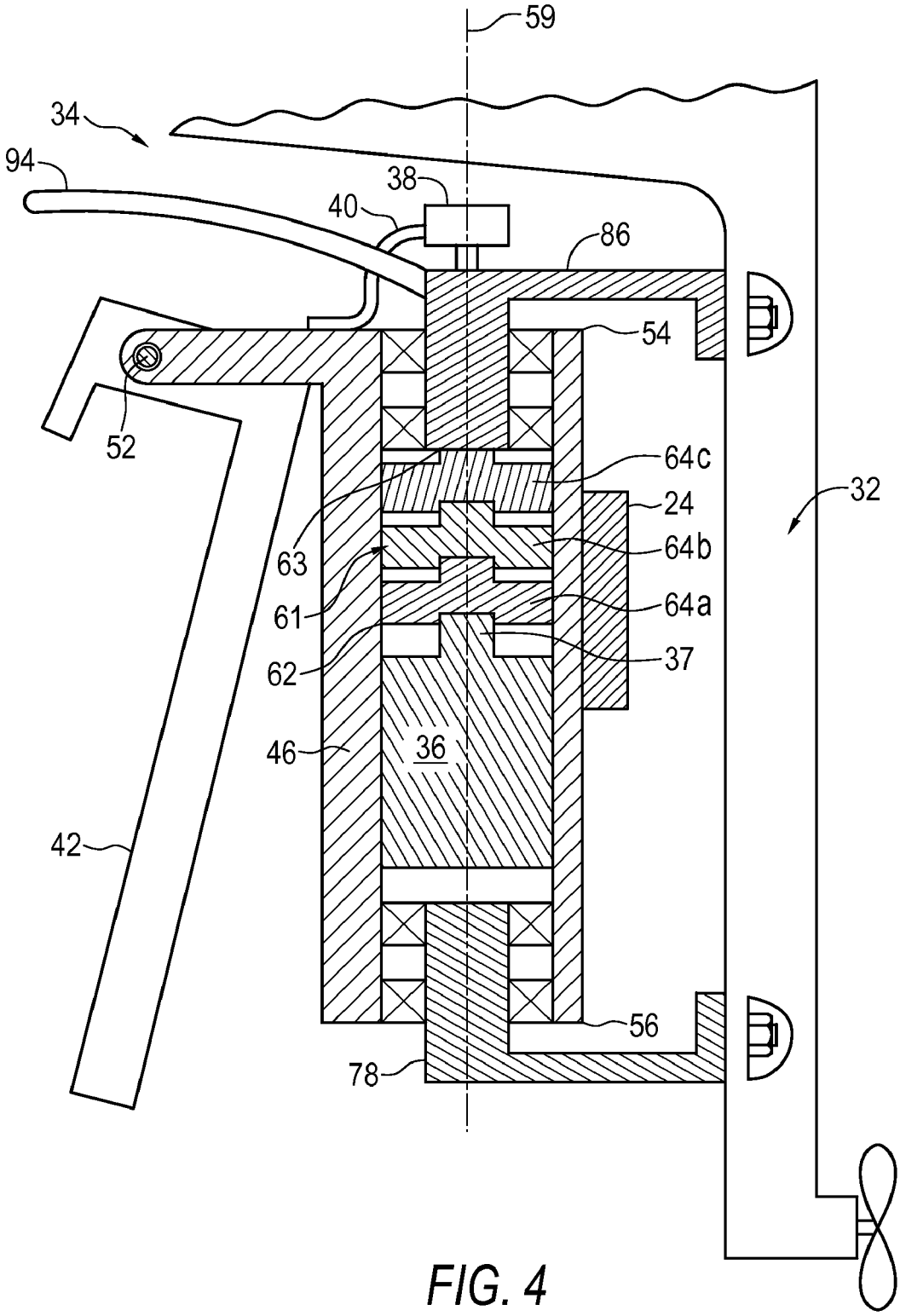
FIG. 4 is a simplified, partly diagrammatised, elevation view partially in section of another embodiment of the steering apparatus.

Another embodiment of the present invention is shown in FIG. 4. FIG. 4 is similar to FIG. 2 with the exception that the drive shaft 37 of the electric motor 36 extends towards the top end 54 of the swivel case 46, and the plurality of planetary gears 61 are interposed between and connect from the motor 36 to upper mount 86. The outboard motor 32 as a result is caused to rotate or swivel through the upper mount 86.

Figure 5:
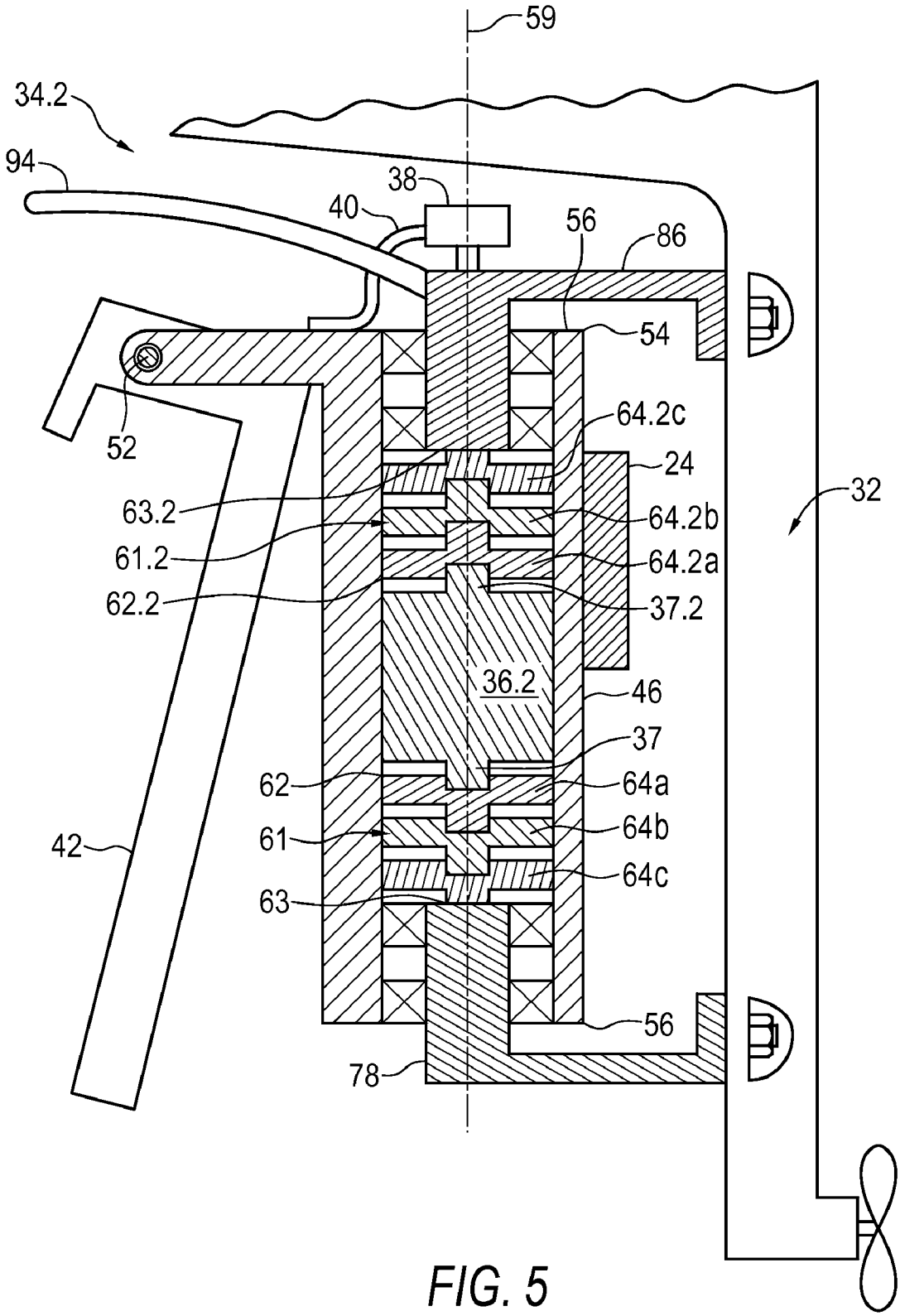
FIG. 5 is a simplified, partly diagrammatised, elevation view partially in section of a further embodiment of the steering apparatus.

A further embodiment of the present invention is shown in FIG. 5 which is similar to FIG. 2 where like parts have like numbers and modified parts have the additional designation "0.2". In this embodiment of the steering apparatus 34.2, the electric motor 36.2 has a drive shaft 37.2 extending towards the top end 54 of the swivel case 46, in addition to the drive shaft 37 extending towards the bottom end 56 of the swivel case 46. A plurality of planetary gears 61.2 are interposed between and connect from the motor 36.2 to upper mount 86, in addition to the plurality of gears 61 interposed between and connecting from the motor 36.2 to lower mount 86. As a result, the outboard motor 32 is caused to rotate by both the upper mount 86 and lower mount 78. As a result of this structure, this embodiment provides the advantage of being a more rugged unit that can bear increased loads. The torsional stress experienced in the drive shaft 37.2 and gears 64.2*a*, 64.2*b*, and 64.2*c* etc is roughly half of the torsional stress experienced in the parts shown in FIGS. 2 and 4.

Figure 6:
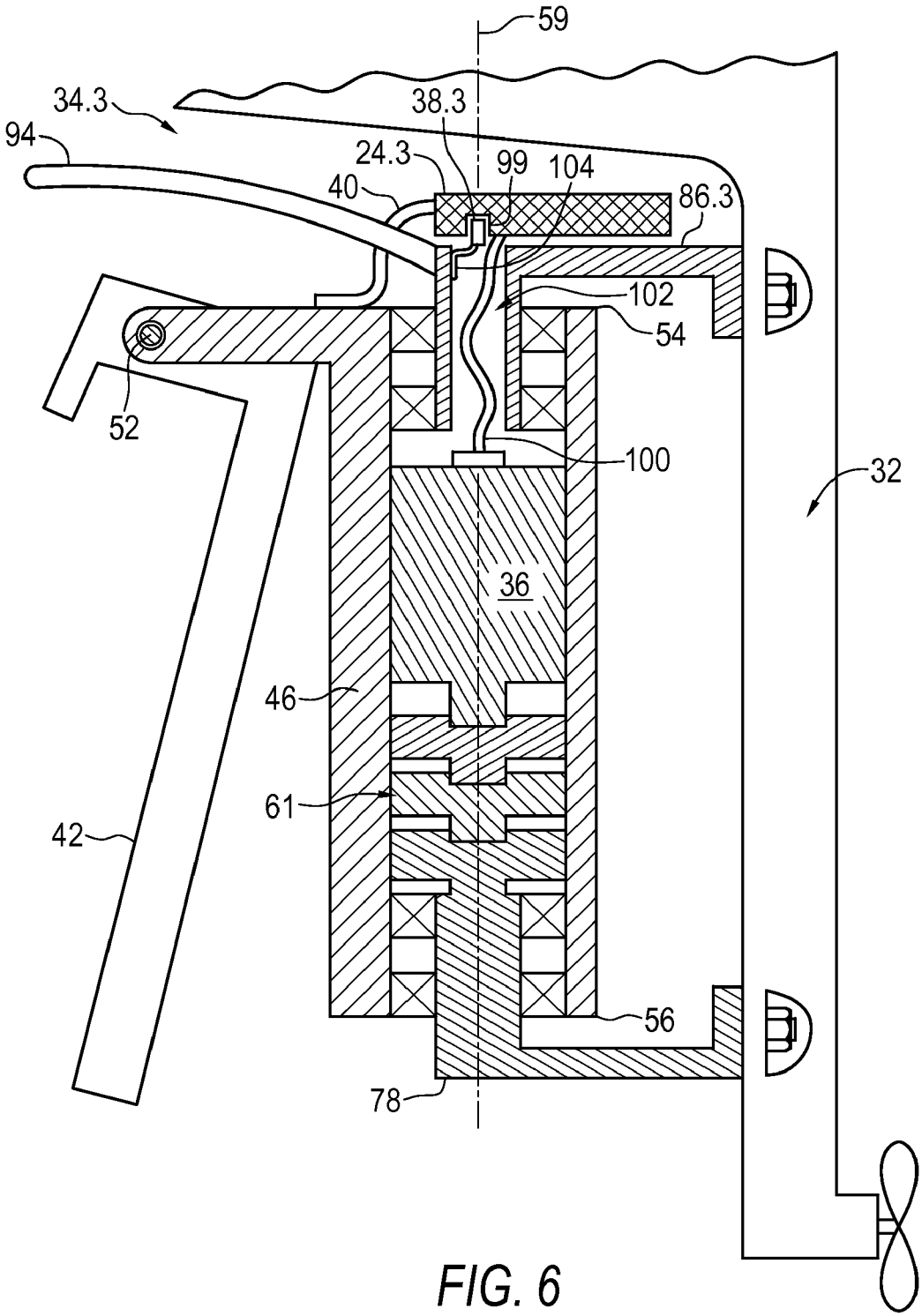
FIG. 6 is a simplified, partly diagrammatised, elevation view partially in section of yet another steering apparatus.

Another embodiment of the present invention is shown in FIG. 6 which is similar to FIG. 2 where like parts have like numbers and modified parts have the additional designation "0.3". In this embodiment of the steering apparatus 34.3, the steering controller 24.3 is positioned by and can be mounted on the upper mount 86.3. A passage, in this example, a bore 102 extends through the upper mount 86.3. The bore 102 in this example is co-axial with the steering axis 59. The bore 102 enables wire 100 to connect from the electric motor 36 to the steering controller 24.3. The steering controller 24.3 has a recess 99. A mounting member 104 partially disposed within the bore 102 is connected to the upper mount 86.3. The rotation sensor 38.3 extends from mounting member 104, is coaxial with the steering axis 59, and is disposed within the recess 99 of the steering controller 24.3. The rotation sensor 38.3 is thereby in communication with the steering controller 24.3. The rotation sensor 38.3 is electrically connected to the steering controller 24.3 to reduce wiring.

Figure 7:
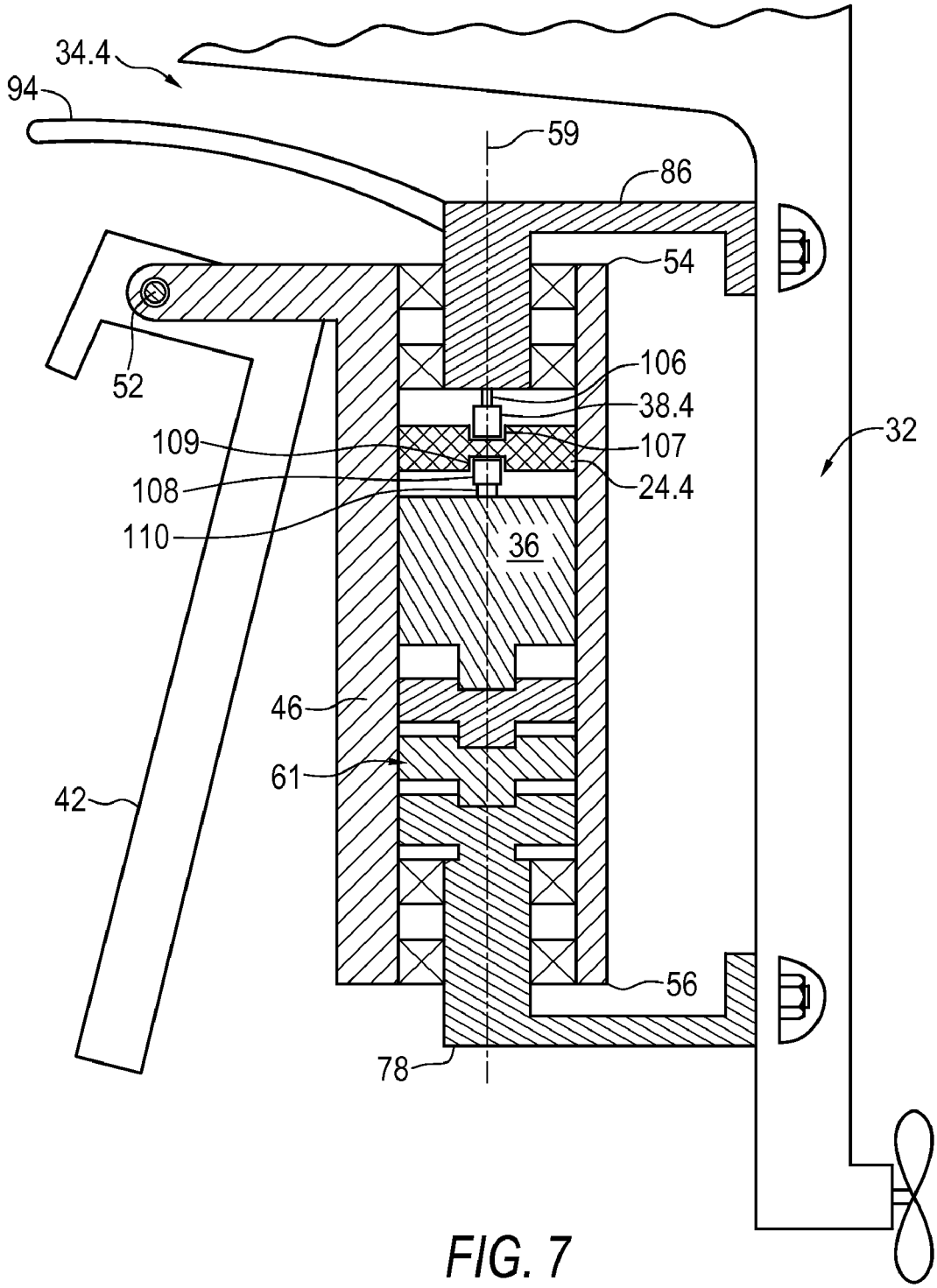
FIG. 7 is a simplified, partly diagrammatised, elevation view partially in section of yet a further steering apparatus.

A further embodiment is shown in FIG. 7, which is similar to FIG. 2 and like parts have like numbers and modified parts have the additional designation "0.4". In this embodiment of the steering apparatus 34.4, the steering controller 24.4 is disposed within the swivel case 46. In this example, the steering controller 24.4 is between the electric motor 36 and the upper mount 86. A first rotation sensor 38.4 is disposed within the swivel case and extends from the upper mount 86 via shaft 106 to within an upper recess 107 of the steering controller 24.4. The first rotation sensor 38.4 in this example is co-axial with the steering axis 59. A second rotation sensor 108 that is co-axial with the steering axis extends from the electric motor 36 via shaft 110 and is within a lower recess 109 of the steering controller 24.4. Since the rotation sensor 108 measures a rotation angle of the motor drive shaft 110, the sensor 108 senses a rotation that is the gear ratio times greater than the rotation of the sensor 38.4. The sensor 108 therefore provides a higher resolution of the steering position.

This embodiment also provides the advantage of being more compact. The steering apparatus 34.4 is also more rugged as more parts are protected from the wear and failures associated with repetitive rotation and the weather, by being disposed with the swivel case 46.

Those skilled in the art will appreciate that these various illustrated embodiments can be combined and overlaid in a great variety of manners. For example, the embodiment shown in FIG. 5 could readily be combined with that of FIG. 7.

Also, those skilled in the art will appreciate that many variations are possible within the scope of the present invention. For example, the gear reducing unit need not be disposed within the swivel case, but rather may be disposed elsewhere on the steering apparatus. In this regard, those skilled in the art will appreciate that the planetary gears need not be mounted in series. Also, the gear reducing unit can be mounted outside of, but parallel with the swivel case. Instead of configuring the ring gear to be stationary, those skilled in the art will appreciate that other gears within each planetary gear stage could alternatively be held stationary to thereby give different gear ratios. The plurality of planet gears need not be restricted to four planet gears, as fewer or more planet gears can be used, as would be appreciated by one skilled in the art. Moreover, the gear reducing unit need not be in the form of planetary gears. For example, the gear reducing unit can comprise spur gears or helical gears, for example, for a steer-by-wire system.

The steering apparatus could have only a lower mount or only an upper mount. Moreover, neither of the mounts 78 and 86 need be mounted within the swivel case 46 nor do they require bearings. For example, the mounts 78 and 86 could simply extend from the output 63 of the plurality of planetary gears 61.

The steering controller 24 can alternatively be installed at the front of the boat 10, for example, in the center console, near the stern of the boat as shown in FIG. 1, or on the outboard motor 32.

The electric motor 36 can be used for a single outboard motor, or for three or more engine applications. Instead having the outboard motor 32, the steering apparatus 34 can be used for a stern drive system. Also, other types of electric motors 36 can be used, such as one with a larger or smaller diameter with different torque and speed characteristics. For example, the present invention can use a DC brushless motor, a stepper motor or a rotary voice coil. In one embodiment, an electric motor 36 at 3000 rpm can be used with a gear reducing unit of 600:1 for reducing swivelling of the outboard motor to about 5 rpm when the motor 36 is operated.

An electric activated solenoid clutch can be used to decouple the electric motor 36 and the plurality of planetary gears 61 if the user wants to use manual rotation of the outboard motor through tiller arm 94 in case of electric failure.

There are many variations for the rotation sensors 38 and 38.1 which can be absolute or incremental in nature. The absolute sensors can be analog hall effect sensors, magnetoresistive sensors, capacitive sensors, or resistor potentiometers. Sensors from Austriamicrosystems™ or Melexsis™ also work well. If incremental sensors are used, they can be secondary sensors to provide higher accuracy or provide redundancy. For example, an encoder, such as an optical encoder, or a digital hall effect sensor can be mounted inside the electric motor 36, as an example for the sensor 108. Such a sensor can measure the motor shaft position. With the high gear ratio provided by the present invention, a high resolution at the output shaft is thereby obtained. An absolute reference can be used to provide an absolute position reference to the system, as an example for the sensor 38. This can be a reel switch, a digital hall effect device, or a low resolution absolute sensor.

It will be understood by someone skilled in the art that many of the details provided above are by way of example only and are not intended to limit the scope of the invention which is to be determined with reference to the following claims.

What is claimed:

1. A steering apparatus for a marine craft having a stern and a propulsion unit, the apparatus comprising:

a stern bracket connectable to the stern of the marine craft;

a swivel case connected to the stern bracket, the swivel case defining a steering axis;

an electric motor substantially coaxially disposed within the swivel case for swivelling the propulsion unit about the steering axis;

a gear reducing unit having an input end connected to the electric motor and an output end; and a first member connected to and extending from the output end of the gear reducing unit, the first member being connectable to the propulsion unit, whereby, when the electric motor is actuated, the motor rotates the first member via the gear reducing unit and swivels the propulsion unit about the steering axis.

2. The steering apparatus as claimed in claim 1, wherein the gear reducing unit comprises planetary gears.

3. The steering apparatus as claimed in claim 1, wherein the gear reducing unit comprises helical gears.

4. The steering apparatus as claimed in claim 1, wherein the gear reducing unit is substantially coaxially disposed within the swivel case.

5. The steering apparatus as claimed in claim 4, wherein the gear reducing unit comprises a plurality of planetary gears.

6. The steering apparatus as claimed in claim 5, wherein the plurality of planetary gears is mounted in series.

7. The steering apparatus as claimed in claim 6, wherein the plurality of planetary gears comprises four stages, each of said stages providing a gear reduction ratio of 5:1.

8. The steering apparatus as claimed in claim 6, wherein the plurality of planetary gears comprises three stages, each of said stages providing a gear reduction ratio of 7:1.

9. The steering apparatus as claimed in claim 6, the swivel case having an interior wall, the plurality of planetary gears comprising stages, each said stage having a sun gear for input connection coaxial with the swivel case, a ring gear abutting the interior wall, a plurality of planet gears interposed between and engageable with both the sun gear and the ring gear, and a planet gear carrier for output connection connecting the plurality of planet gears together, the planet gear carrier of each of said stage connecting to the sun gear of an adjacent one of the stages.

10. The steering apparatus as claimed in claim 9, wherein the ring gear is stationary for each of the plurality of stages.

11. The steering apparatus as claimed in claim 9, wherein the input end of the gear reducing unit is a sun gear from a first one of the plurality of stages, and the output end of the gear reducing unit is adjacent to a planet gear carrier of a last one of the plurality of stages.

12. The steering apparatus as claimed in claim 1, wherein the swivel case has a top end and a bottom end spaced apart from the top end, the first member extending outwards from one of said top end and said bottom end.

13. The steering apparatus as claimed in claim 12, wherein the first member is rotatably mounted to the swivel case and has a portion coaxial in part with the steering axis.

14. The steering apparatus as claimed in claim 13, further comprising a second member rotatably mounted within the swivel case and extending from another one of said top end and said bottom end, the second member being connectable to the propulsion unit.

15. The steering apparatus as claimed in claim 14, the second member further comprising a portion coaxial in part with the steering axis.

16. The steering apparatus as claimed in claim 1, further including a control means for controlling the electric motor, whereby when the electric motor is actuated, the propulsion unit swivels about the steering axis.

17. The steering apparatus as claimed in claim 16, the control means including a rotation sensor operatively connected to the swivel case.

18. The steering apparatus as claimed in claim 17, the control means further including a steering controller having a recess, the rotation sensor being at least partially disposed within the recess for communication with the steering controller.

19. The steering apparatus as claimed in claim 18, the swivel case having a top end and a bottom end spaced apart from the top end, the first member extending outwards from one of said top end and said bottom end, the first member having a passage for enabling the electric motor to electrically connect with the steering controller, and the rotation sensor being connected to the first member.

20. The steering apparatus as claimed in claim 1, the swivel case further having an elongate passageway defining the steering axis, the electric motor being substantially coaxially disposed within the passageway of the swivel case.

21. The steering apparatus as claimed in claim 20, further including a control means for controlling the electric motor, the control means including a steering controller disposed within the passageway and positioned between the first member and the electric motor, the steering controller having an upper recess facing the first member and a lower recess facing the electric motor, the control means including a first rotation sensor extending from the first member for measuring rotation of the propulsion unit about the steering axis, the first rotation sensor being at least partially disposed within the upper recess, and a second rotation sensor operatively connected to and extending from the electric motor for measuring a rotation angle of the motor drive shaft, the second rotation sensor being at least partially disposed within the lower recess, the first rotation sensor and second rotation sensor thereby being in communication with the steering controller.

22. The steering apparatus as claimed in claim 1, wherein the swivel case is pivotally connected to the stern bracket for tilting about a tilt axis.

23. A steering apparatus for a marine craft having a stern and a propulsion unit, the apparatus comprising:

a stern bracket connectable to the stern of the marine craft;

a swivel case connected to the stern bracket, the swivel case having a top end and a bottom end spaced apart from the top end, and the swivel case defining a steering axis, an electric motor coaxially disposed within the swivel case for swivelling the propulsion wait about the steering axis, the electric motor having a lower shaft extending towards the bottom end, and an upper shaft opposite the lower shaft, the upper shaft extending towards the top end;

a plurality of lower planetary gears having an input end connected to the lower shaft of the electric motor and an output end; a plurality of upper planetary gears having an input end connected to the upper shaft of the electric motor and an output end;

a first member connected to and extending from the output end of the lower planetary gears, the first member being connectable to the propulsion unit; and a second member connected to and extending from the output end of the upper planetary gears, the second member being connectable to the propulsion unit, whereby, when the electric motor is actuated, the motor rotates the first member via the lower planetary gears, rotates the second member via the upper planetary gears, and swivels the propulsion unit about the steering axis thereby.

24. The steering apparatus as claimed in claim 23, wherein the lower planetary gears and the upper planetary gears are coaxially disposed within the swivel case, and the first member and the second member are rotatably mounted to the swivel case.

25. In combination, a propulsion unit and a steering apparatus for mounting on a stern of a marine craft, the steering apparatus comprising:

a stern bracket connectable to the stern of the marine craft;

a swivel case connected to the stern bracket, the swivel case defining a steering axis;

an electric motor coaxially disposed within the swivel case for swivelling the propulsion unit about the steering axis;

a gear reducing unit having an input end connected to the electric motor and an output end; and a first member connected to and extending from the output end of the gear reducing unit, the first member being connectable to the propulsion unit, whereby, when the electric motor is actuated, the motor rotates the first member via the gear reducing unit and swivels the propulsion unit about the steering axis.

26. The combination as claimed in claim 25, the propulsion unit being one from the group consisting of an outboard motor and a stern drive.

27. A steering apparatus for a marine craft having a stern and a propulsion unit, the apparatus comprising:

a stern bracket connectable to the stern of the marine craft;

a swivel case connected to the stern bracket, the swivel case defining a steering axis;

an electric motor substantially coaxial with the steering axis for swivelling the propulsion unit about the steering axis;

a gear reducing unit having an input end connected to the electric motor and an output end, the gear reducing unit comprising planetary gears; and a first member connected to and extending from the output end of the gear reducing unit, the first member being connectable to the propulsion unit, whereby, when the electric motor is actuated the motor rotates the first member via the gear reducing unit and swivels the propulsion unit about the steering axis.

28. A steering apparatus for a marine craft having a stern and a propulsion unit, the apparatus comprising:

a stern bracket connectable to the stern of the marine craft;

a swivel case connected to the stern bracket, the swivel case having a swivel axis;

a gear reducing unit operatively connected to the swivel case and substantially coaxial with the swivel axis, the gear reducing unit comprising planetary gears, the gear reducing unit having an input end and an output end;

an electric motor connected to the input end of the gear reducing unit;

a first member connected to and extending from the output end of the gear reducing unit, the first member being connectable to the propulsion unit; and a control means for controlling the electric motor, whereby when the electric motor is actuated, the motor rotates the first member via the gear reducing unit and swivels the propulsion unit about the swivel axis.

29. The steering apparatus of claim 28, wherein the planetary gears are disposed within the swivel case.

30. The steering apparatus of claim 28, wherein the electric motor has a drive shaft with a motor axis substantially parallel to the swivel axis.

31. The steering apparatus of claim 29, wherein the electric motor has a drive shaft with a motor axis substantially parallel to the swivel axis.

32. A steering apparatus for a marine craft having a stern, a propulsion unit, and an electric motor for steering the propulsion unit, the apparatus comprising:

a stern bracket connectable to the stern of the marine craft;

a swivel case connected to the stern bracket, the swivel case defining a steering axis, the electric motor being operatively connectable to the swivel case for swivelling the propulsion unit about the steering axis a gear reducing unit operatively connected to the swivel case, the gear reducing unit comprising planetary gears, the gear reducing unit having an input end and an output end both substantially coaxial with the steering axis, the input end of the gear reducing unit connecting to the electric motor; and a first member connecting to and extending from the output end of the gear reducing unit, the first member being connectable to the propulsion unit, whereby, when the electric motor is actuated, the motor rotates the first member via the gear reducing unit and swivels the propulsion unit about the steering axis.

* * * * *